US005086539A

United States Patent [19]

Rench

[11] Patent Number: 5,086,539

[45] Date of Patent: Feb. 11, 1992

[54] CARPET CLEANING MACHINE WITH PATTERN-ORIENTED VACUUM NOZZLE

[75] Inventor: Geoffrey B. Rench, Racine, Wis.

[73] Assignee: Racine Industries, Inc., Racine, Wis.

[21] Appl. No.: 607,363

[22] Filed: Oct. 31, 1990

[51] Int. Cl.[5] ..... A47L 5/30

[52] U.S. Cl. ..... 15/384; 15/320

[58] Field of Search ..... 15/320, 384, 418, 419, 15/420, 421, 340.1

[56] References Cited

U.S. PATENT DOCUMENTS

| | | | |
|---|---|---|---|
| 478,942 | 7/1892 | Pease . | |
| 664,135 | 12/1900 | DuFour . | |
| 715,408 | 12/1902 | Murray et al. . | |
| 755,596 | 3/1904 | Keyes . | |
| 1,069,608 | 8/1913 | Ewing et al. . | |
| 1,069,773 | 8/1913 | Duthie . | |
| 1,169,191 | 1/1916 | Quist . | |
| 1,211,948 | 1/1917 | Koster et al. . | |
| 1,268,963 | 6/1918 | Gray . | |
| 1,417,768 | 5/1922 | Radimak | 15/320 X |
| 1,483,976 | 2/1924 | Hoover . | |
| 1,514,949 | 11/1924 | Bell et al. | 15/384 X |
| 1,644,859 | 10/1927 | Strader . | |
| 1,759,881 | 5/1930 | Bentley | 15/384 |
| 2,960,714 | 11/1960 | Senne | 15/349 |
| 3,753,268 | 8/1973 | Bayless | 15/377 |
| 4,097,953 | 7/1978 | McKinney et al. | 15/320 |
| 4,221,019 | 9/1980 | Jager et al. | 15/368 |
| 4,267,617 | 5/1981 | Brown et al. | 15/320 |
| 4,419,784 | 12/1983 | Lex | 15/344 |
| 4,457,042 | 7/1984 | Jones et al. | 15/320 X |
| 4,512,057 | 4/1985 | Laing et al. | 15/320 |
| 4,654,916 | 4/1987 | Postonen et al. | 15/50 C |
| 4,862,551 | 9/1989 | Martinez et al. | 15/340.1 X |

FOREIGN PATENT DOCUMENTS

| | | | |
|---|---|---|---|
| 237140 | 7/1960 | Australia | 15/384 |
| 3316847A1 | 7/1983 | Fed. Rep. of Germany . | |
| 496547 | 7/1954 | Italy | 15/384 |
| 97369 | 11/1939 | Sweden | 15/384 |
| 98766 | 4/1940 | Sweden . | |

*Primary Examiner*—Chris K. Moore

*Attorney, Agent, or Firm*—Jansson & Shupe, Ltd.

[57] ABSTRACT

In one embodiment, a carpet cleaning machine includes a pair of spaced, long-bristled, counter-revolving brushes for stroking solvent-moistened cleaning granules into and across the carpet fibers. A shroud is disposed above the brushes and has a bottom surface spaced from the brushes. At least one independently-operable vacuum nozzle is provided and has an inlet for receiving the granules to be removed from the carpet. This inlet is located adjacent the bottom surface of the shroud and is positioned generally coincident with the throw pattern defined by the granules as they are cast against the bottom surface of the shroud by the brushes. The machine thereby applies cleaning granules to a carpet and more efficiently removes such granules therefrom by vacuuming following carpet cleaning. In a second embodiment, two inlets are used and similarly positioned coincident with the granule throw pattern.

8 Claims, 5 Drawing Sheets

CARPET CLEANING MACHINE WITH PATTERN-ORIENTED VACUUM NOZZLE

FIELD OF THE INVENTION

This invention is related generally to carpet cleaning machines and, more particularly to a carpet cleaning machine which sequentially applies cleaning granules to carpet for removing dirt therefrom and then removes such granules by vacuuming.

BACKGROUND OF THE INVENTION

The three primary approaches used to clean commercial and residential carpets are steam or hot water, foam and dry systems. Dry-type carpet cleaning systems are further divided into two broad categories, namely, those using a dry or substantially dry powder and those using granules which are slightly moistened with cleaning solvents for dirt removal. The inventive machine has utility for both categories of dry systems but relates primarily to those using granules rather than powder. Such machine also has utility in situations where only carpet vacuuming is performed. That is, its aggressive, long-bristled brushes are highly effective in removing loose sand and other soil not requiring the application of solvent-bearing material.

Of the dry granular carpet cleaning systems, the best known and most widely used is the HOST® dry extraction system offered by Racine Industries, Inc. of Racine, Wis. The HOST® system applies granules to carpet fibers using a machine as shown in Rench et al. U.S. Pat. Nos. 2,842,788 and 2,961,673. Such machine, sold under the HOST® trademark, is devoid of vacuum capability and has a pair of spaced brushes counter-rotating at relatively low speed (about 350 rpm) to stroke the cleaning granules into, through and across carpet fibers. The granules are referred to as "dry" and are substantially so even though moistened with cleaning solvents. When stroked as described, these granules "scrub" soil and dirt from such fibers including oily and non-oily soil. The carpet is cleaned by working the HOST® machine across it in different directions. During the cleaning process, granules migrate to the carpet backing adjacent the base of the fiber. A few granules also adhere lightly to the fibers along their lengths. Following cleaning, conventional carpet vacuum machines are used for removing the dirt-ladened granules.

Because of the way they are constructed, conventional vacuum machines are not ideally suited for the removal of such dirt-ladened granules although such machines do a reasonably acceptable job of such removal. In particular, most such machines employ a single "beater bar" which rotates at high speed and which uses spaced rows of relatively short bristles. A few such machines have two beater bars which are constructed and operate in much the same way. Such high speed beater bars with short bristles are more effective in removing granules near the tops of the fibers but significantly less so as to granules which are "deep down" in the carpet.

Another disadvantage of such machines is that the beater bars are driven by smooth-surfaced, flexible rubber belts which wrap partially around the bar. The solvent used to moisten the granules often causes the belt to slip, thereby temporarily disabling the beater bar.

Further, the embodiment of carpet brushing and carpet vacuuming capabilities in two separate machines means that both such machines must be available to complete the cleaning process. This represents an extra equipment expense and for the professional carpet cleaner, it also represents added time (reflected in employee wages) required to get the necessary machines to the job site and to later remove such machines. Examples of conventional vacuum machines are shown in U.S. Pat. Nos. 1,891,504 and 4,426,751.

One type of machine used to apply dry cleaning powder to carpet fiber is made by Clarke-Gravely Corporation of Muskegon, Michigan and sold as the CLARKE CAPTURE carpet cleaning system. Such machine distributes cleaning powder onto the carpet and works the powder into and through the carpet fibers using a round, disk-like scrubber brush, the axis of rotation of which is normal to the carpet surface. The machine vacuum system operates to reduce dust. After cleaning, a separate conventional vacuum machine is used to remove the powder.

Another type of system used for cleaning carpets with powder is the DRYTECH cleaning machine sold by Sears, Roebuck & Company. The machine has a self-contained vacuum capability and one beater bar with several rows of short-bristled brushes. Such bar is within a shroud which generally conforms to the shape of the bar and by which vacuum is selectively applied. As the brush alone is rotated at high speed, powder is dispensed through two slits, one on either side of the bar between the bar and the shroud. Later, the vacuum is actuated and dry powder (with dirt entrained) is dislodged by the brush and drawn away by vacuum.

Several patents show machines which combine brush and vacuum features for removing dirt from a surface. Although such machines are described as being used to clean hard surfaces such as uncarpeted floors, streets and cisterns, there are certain characteristics worthy of mention. For example, the machine shown in Bentley U.S. Pat. No. 1,759,881 uses spaced counter-revolving brushes and two vacuum inlet passages. Each passage is defined by a scraper blade and one side of a V-shaped deflector. Material scraped from a brush by a blade is drawn into the vacuum inlet The inlets are positioned at that part of the brush contacted by the scraper, presumably for the purpose of immediately "capturing" material dislodged by the scraper. The brushes and vacuum operate simultaneously.

A machine used to clean out tanks is shown in Murray et al. U.S. Pat. No. 715,408. The Murray machine uses spaced counter-revolving brushes and a vacuum tube, the nozzle of which is at the location where the brushes are in closest proximity to one another.

A street and lawn sweeping machine is shown in Keyes U.S. Pat. No. 755,596. The Keyes machine has separate support wheels, a pair of contacting, counter-revolving brushes and an exhaust fan to carry away dirt. The vacuum inlet opens at a location above and in general registry with the line of contact of the bristles on the brush rollers.

A type of cleaning machine is also shown in German Patent DE 33 16847 A1. Such machine uses a pair of spaced, counter-revolving brushes with spaced rows of bristles. A vacuum nozzle extends the length of the brushes and apparently has two panels, each of which is in contact, or nearly in contact, with a brush. The brushes and vacuum appear to operate simultaneously.

A street cleaning machine is shown in Duthie U.S. Pat. No. 1,069,773 and has a pair of counter-revolving brushes, each of which is substantially confined within its own shroud. Each shroud has a vacuum tube connected thereto for dirt removal.

A vacuum cleaning tool is shown in Bayless U.S. Pat. No. 3,753,263. The Bayless tool uses separate support wheels and a pair of counter-rotating beater bars fitted with rigid vanes or with brushes. A vacuum nozzle is positioned between the bars and in close proximity to the carpet. The tool is said to separate the fibers of deep pile shag rugs so that the vacuum nozzle may extract dirt therefrom.

None of the machines discussed above provide the advantages of a dual machine capability to first apply dry carpet cleaning granules to a carpet for cleaning its fibers and later remove the dirt-ladened granules from the carpet using one or more vacuum nozzles which are independently operable. Further, the designers of such machines failed to appreciate how such vacuum nozzles can advantageously be positioned to take advantage of the granule "throw pattern" for most efficient granule removal.

That is, as a carpet is being cleaned using dry granules, such granules are thrown or cast from the tips of the brush bristles along trajectories generally tangent to the brush and generally perpendicular to (but spaced from) the axis of rotation of the brush. Some of these granules are cast against the shroud which covers the brushes and define a "throw pattern" on the bottom surface of such shroud. Such throw pattern may be a single, generally rectangular area positioned directly above the space between the brushes or such pattern may comprise two such areas which are spaced apart from one another.

Earlier workers in this field have failed to understand how one or more vacuum nozzles may be positioned in the shroud to be generally coincident with such throw pattern, thereby providing a more efficient vacuuming capability. A machine having relatively low speed, long-bristled, counter-revolving brushes for first applying dry carpet cleaning granules in the absence of vacuum and later using the combined action of the brushes and the independently operable vacuum to remove the granules from the carpet would be an important advance in the art.

OBJECTS OF THE INVENTION

It is an object of this invention to overcome some of the problems and shortcomings of the prior art.

Another object of this invention is to provide an improved carpet cleaning machine for applying substantially dry cleaning granules to the carpet and later removing such granules by vacuum.

Another object of this invention is to provide an improved carpet cleaning machine having at least one vacuum nozzle with its inlet positioned generally coincident with a throw pattern defined by granules cast against the bottom surface of the machine shroud.

Still another object of this invention is to provide an improved carpet cleaning machine wherein in one embodiment the vacuum nozzle is mounted in a platform positioned between those front and rear portions of the machine shroud which are generally conformably shaped to the curvature of the brushes.

Yet another object of this invention is to provide an improved carpet cleaning machine wherein in another embodiment, a vacuum nozzle is positioned at each of two areas of the granule throw pattern.

Another object of this invention is to provide an improved carpet machine wherein each vacuum nozzle has a length about equal to that of the brushes and a width about equal to that of the throw pattern or a area thereof. These and other important objects will be apparent from the descriptions of this invention which follow.

SUMMARY OF THE INVENTION

The HOST® carpet cleaning machine as described above and as depicted in the aforementioned Rench et al. patents has a pair of spaced counter-revolving brushes, the bristles of which are relatively long, relatively stiff and substantially evenly distributed. Such brush arrangement has long been demonstrated to be highly effective in brushing the HOST® dry cleaning granules into, through and across carpet fibers, even relatively long carpet fibers. Such brushes are also very effective in "digging" granules out of the carpet including those deep-down granules which have migrated into the carpet to the backing. The brushes redistribute the granules about the carpet by casting them from bristle tips to be again worked into and out of the fibers.

When so cast, the granules strike the entirety of the bottom surface of the shroud which is placed over and partially around the brushes. However, it has been discovered that as granules are urged out of the carpet by the long, relatively stiff bristles, they strike the bottom surface of the shroud unevenly. That is, the pattern of granule impact is not uniform but rather, is significantly more dense in certain areas. These areas define what is called a "throw pattern."

The inventive machine takes advantage of this granule patterning effect by placing one or two vacuum nozzles at a location or locations coincident with the throw pattern. After they have done their cleaning job by being repeatedly stroked across the carpet fibers, the granules are quickly and efficiently removed from the carpet by energizing the independently-operable vacuum nozzle(s). Such nozzle(s) receive granules cast from the tips of the still-rotating brushes and remove them to a collection chamber.

The improved machine includes a pair of spaced, long-bristled, counter-revolving brushes for stroking the granules into and across the carpet fibers. A shroud is disposed above the brushes and has a bottom surface spaced from the brushes. At least one independently-operable vacuum nozzle is provided and has an inlet for receiving the granules to be removed from the carpet. This inlet is located adjacent the bottom surface of the shroud. The vacuum nozzle is positioned generally coincident with the throw pattern defined by the granules as they are cast against the bottom surface of the shroud by the brushes. The machine thereby applies cleaning granules to a carpet and more efficiently removes such granules therefrom by vacuuming following carpet cleaning.

In a highly preferred embodiment, the nozzle has a pair of spaced panels, one each along the front and rear edges of the nozzle. These panels extend substantially across the width of the machine and from the nozzle downward toward the carpet. Each such panel has a lower, generally horizontal edge positioned in close proximity to a brush. Such panels enhance the granule-retrieving capability of the nozzle.

The brushes are generally cylindrical in shape and the shroud has a front portion and a rear portion, both of which are generally conformably shaped to the curvature of the brushes. A horizontal, generally planar platform is positioned between the front portion and the rear portion and the vacuum nozzle is mounted in the platform.

A second highly preferred embodiment of the machine is arranged in recognition of a throw pattern having two separate areas, one on each of the two curved bottom surfaces of the shroud adjacent the platform. Such machine includes a second vacuum nozzle, the inlet of which is also adjacent the bottom surface of the shroud. The nozzles are positioned generally coincident with each of such areas of the throw pattern. In the second embodiment, both vacuum nozzles operate simultaneously. In either embodiment, the throw pattern has a length which extends across the brushes and the length of a nozzle is about equal to that of the area of the &throw pattern associated with the nozzle.

The vacuum capability may be provided in any of several ways. For example, a separate motor may be mounted on the machine to provide vacuum to the nozzle(s). Vacuum may also be provided by a separate vacuum-creating machine connected to the carpet cleaning machine by a flexible hose. Such machines are embodied as either (or both) of at least two types. One type is caster-mounted, has its own vacuum motor and waste collection drum and is sold under the "SHOP-VAC" name. Another type is mounted on a motor vehicle and the flexible hose extended into the building and attached to the machine when vacuuming is to be performed.

The preferred machine is devoid of separate support wheels. That is, the brush has bristles which are relatively stiff and substantially continuously disposed about the brush. These bristles deflect only slightly during machine operation and the machine is supported entirely by the counter-revolving brushes when in operation. The aforementioned Rench et al. patents are incorporated herein by reference for their teaching regarding the basic structure used to make the inventive machine.

DETAILED DESCRIPTIONS OF PREFERRED EMBODIMENTS

The FIGURES show the improved carpet cleaning machine 10 in accordance with the invention.

Understanding of the inventive machine 10 will be aided by an expanded explanation of the carpet cleaning system with which it is particularly suited to be used. However, it is to be appreciated that there are other granular-type dry carpet cleaning systems in use and the machine 10 will also work well with such systems.

The HOST ® CARPET CLEANING SYSTEM

Figure 3A:
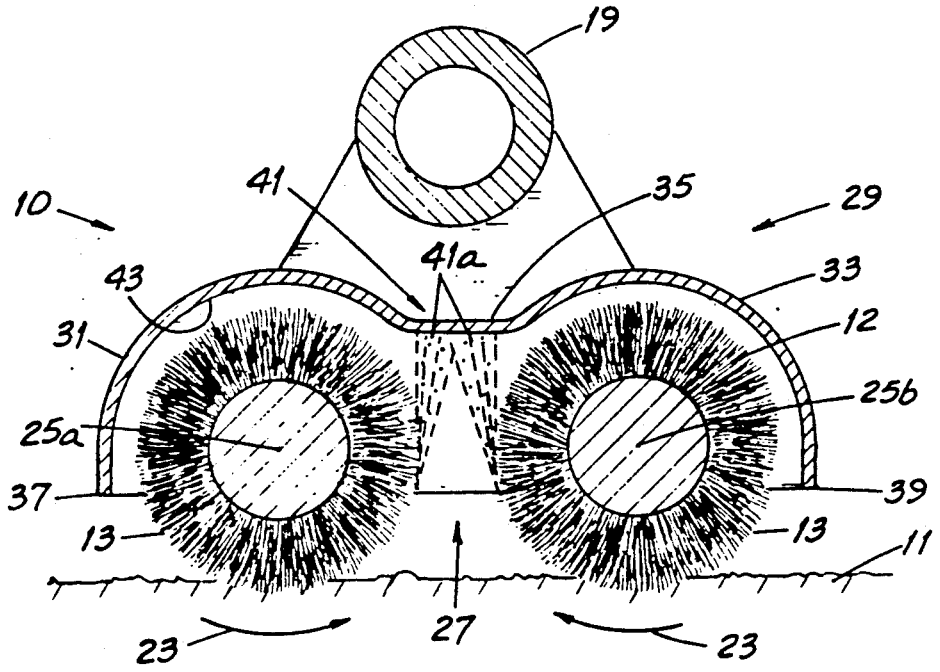
FIG. 3A is a cross-sectional side elevation view of a portion of the machine shown in FIG. 1, taken along the viewing plane 3—3 thereof, with the vacuum nozzle and other parts omitted to show the granule throw pattern of the first embodiment.
Figure 3B:
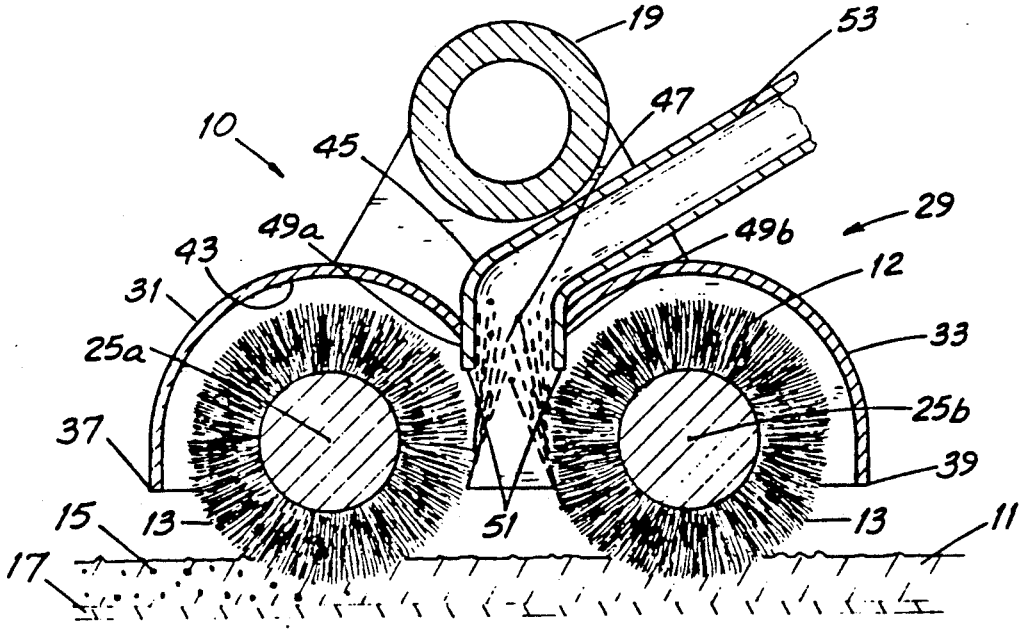
FIG. 3B is a cross-sectional side elevation view similar to FIG. 3A and showing the vacuum nozzle of the first embodiment.

Referring to FIG. 3B, the HOST ® dry carpet cleaning system uses cleaning granules 11 which are slightly moistened with cleaning solvents. These granules 11 are sprinkled on the carpet 12 by hand (much as one distributes grass seed upon turf) or by using an applicator drum designed for the purpose. After such granules 11 are relatively evenly distributed on the carpet 12, the counter-revolving brushes 13 of the machine 10 are actuated and their long, relatively stiff bristles 15 work the moistened granules 11 deep into the carpet pile and across the carpet fibers 16. These granules 11 are like thousands of tiny absorbing "scrubbers" which collect and retain dirt thereon. To achieve optimum cleaning, the machine 10 (with vacuum de-activated) is worked across the carpet 12 in a forward and back motion which also includes lateral movement. The pattern defined by the machine 10 is saw-toothed in shape. After completely covering and cleaning the carpet 12 in that manner, the machine 10 is re-oriented so that the direction of the forward and back motion is generally perpendicular to that used initially. The machine 10 may also be again re-oriented so that the direction of the forward and back motion is at about a 45° angle to those used previously.

As a result of this activity, the carpet fibers 16 are well cleaned and the dirt-laden granules 11 appear not only visibly at the top of the carpet 12 but also along the carpet fibers 16 and at the lower ends of the fibers 16 where they are joined to the carpet backing 17. These cleaning granules 11 have been so positioned by the action of the relatively stiff long bristled brushes 13 which repeatedly "stroke" the granules 11 across the fibers 16 by continuous redistribution and rebrushing.

Following such carpet cleaning, the granules 11 are removed by the machine 10 in the manner described below.

The Inventive Machine

Figure 2:
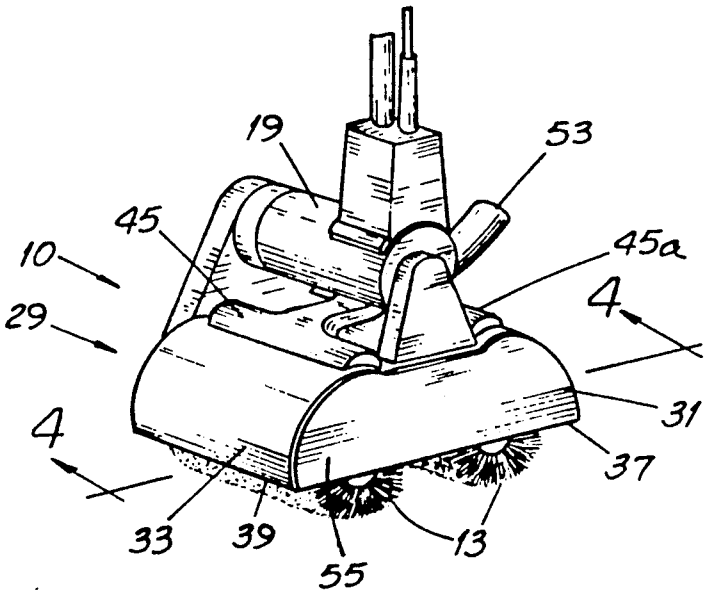
FIG. 2 is an elevation perspective view similar to that of FIG. 1 but showing a second embodiment of the machine and the side of the machine opposite that shown in FIG. 1.
Figure 1:
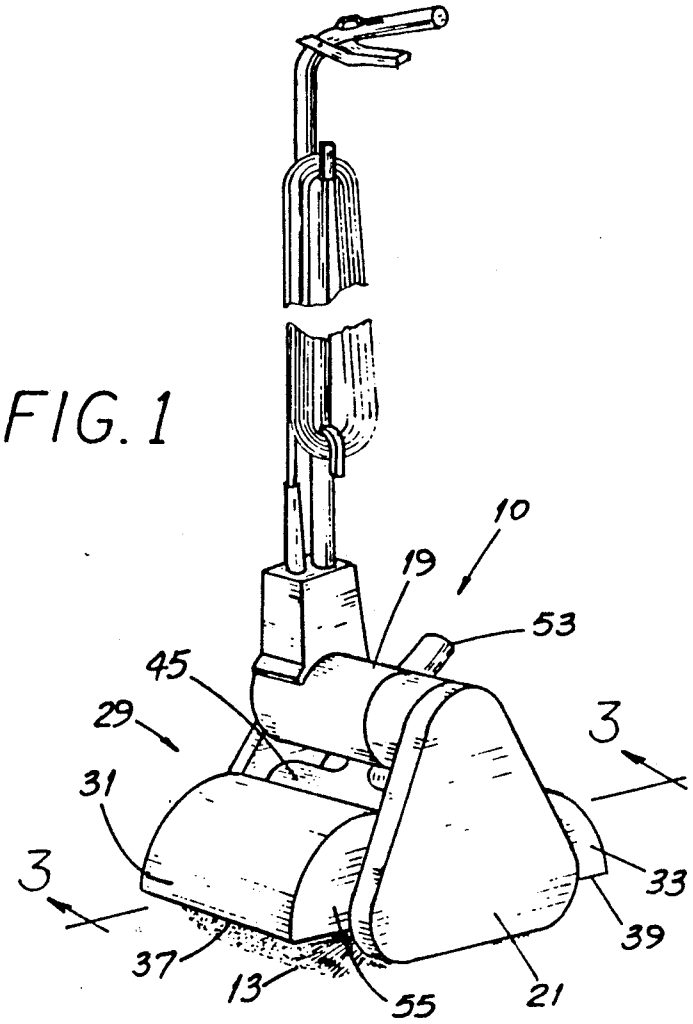
FIG. 1 is an elevation perspective view of a first embodiment of the machine.

A first embodiment of the machine 10 is shown in FIGS. 1, 2 and 3A and includes an electric motor 19 coupled to a pair of counter-revolving brushes 13 by a plurality of gear trains within the gear housing 21.

Brush rotation is in the direction shown by the arrows 23 and is at about 350 rpm. The axes of rotation 25*a*, 25*b* of the brushes 13 are generally parallel and located so that a space 27 is defined between the brushes 13. Each brush 13 is generally cylindrical and made of bristle tufts closely spaced to one another. The resulting appearance of the outer perimeter of the brush 13 is relatively uniform without significant spaces between tufts and with essentially no spaces delineating rows or groupings of bristles 15.

The bristles 15 are rather stiff and yield or bend only slightly as they engage the carpet fibers 16 and stroke the granules 11 into and through the fibers 16. The exposed length of the bristles 15 is about one-half of the radius of the brush 13. Because the weight of the machine 10 is supported entirely by the brushes 13 rotating in opposite directions, the machine 10 has little or no tendency to creep or drift across the carpet 12.

Interposed between the brushes 13 and the drive motor 19 is a protective shield or shroud 29 having a front portion 31, a rear portion 33 and a horizontal, generally planar platform 35 between the portions 31, 33. Each portion 31, 33 is shaped to conform generally to the curvature of the brush 13 associated therewith and terminates in a front edge 37 and a rear edge 39. These edges 37, 39 are generally parallel to and spaced above the carpet 12.

In FIG. 3A, the vacuum nozzle (as shown in FIG. 3B) is omitted to better describe the throw pattern 41 defined by the cleaning granules 11. Such granules 11 are "carried" at or near the tips of the bristles 15 and as the tips emerge from the carpet 12, the granules 11 are thrown or cast toward the bottom surface 43 of the shroud 29. When so cast, the granules 11 strike the entirety of the bottom surface 43. However, they do so unevenly. That is, the pattern of granule impact is not uniform but rather, is significantly more dense in a certain area or areas 41*a*. These areas 41*a* define the throw pattern 41 which is shown in FIG. 3A to be generally coincident with the platform 35 positioned between the portions 31, 33.

Referring additionally to FIG. 3B, in one embodiment of the invention, the machine 10 includes a first vacuum nozzle 45 positioned generally coincident with the location of the throw pattern 41. The nozzle 45 has an inlet 47 for receiving the granules 11 to be removed from the carpet 12 and this inlet 47 is generally adjacent the bottom surface 43 of the shroud 29.

The nozzle 45 also has a pair of spaced panels 49*a*, 49*b*, one each along the front and rear edges of the nozzle 45. These panels 49*a*, 49*b* extend substantially across the width of the machine 10 and from the nozzle 45 downward toward the carpet 12. Each such panel 49*a*, 49*b* has a lower, generally horizontal edge 51 positioned in close proximity to a brush 13. Each edge 51 is positioned above a plane defined by the axes of rotation 25*a*, 25*b* of the brushes 13. Such panels 49*a*, 49*b* enhance the granule-retrieving capability of the nozzle 45 by deflecting toward the inlet 47 many of those granules which may otherwise miss the inlet 47 and strike the shroud 29.

The throw pattern 41 has a length extending along the length of the brushes 13 and in a highly preferred arrangement, the length of the nozzle 45 is about equal to that of the throw pattern 41. Similarly, the throw pattern 41 has a width which in FIGS. 3A and 3B is about equal to the width of the platform 35 and the preferred nozzle 45 has a generally corresponding width. The inlet 47 is in air-flow communication with a conductor 53 connected to (or connectable to) a vacuum-creating machine 59 as described below.

Figure 4A:
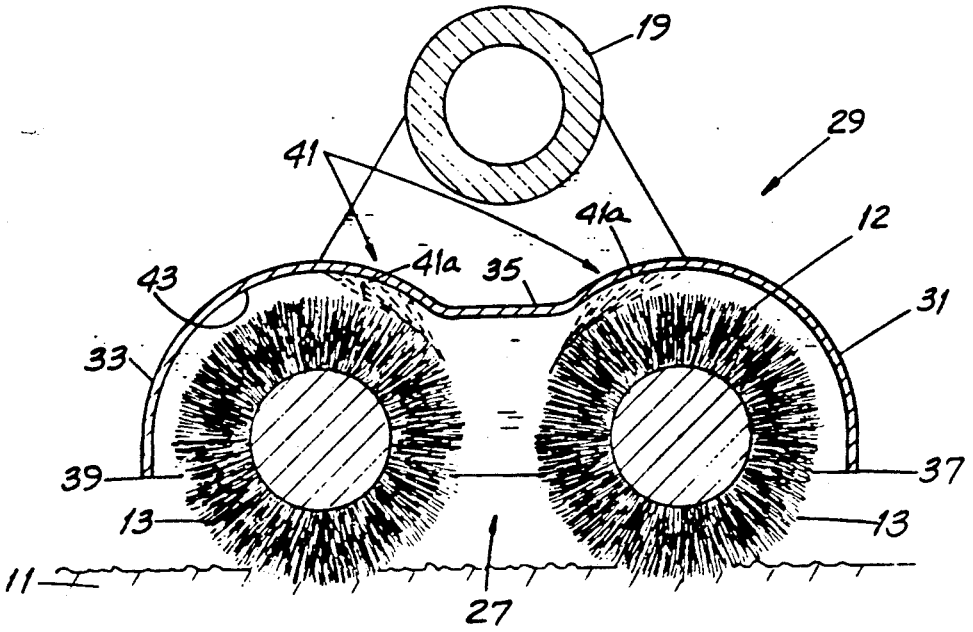
FIG. 4A is a cross-sectional side elevation view of the machine shown in FIG. 2, taken along the viewing plane of 4—4 thereof, with the vacuum nozzles and other parts omitted to show the granule throw pattern of the second embodiment.
Figure 4B:
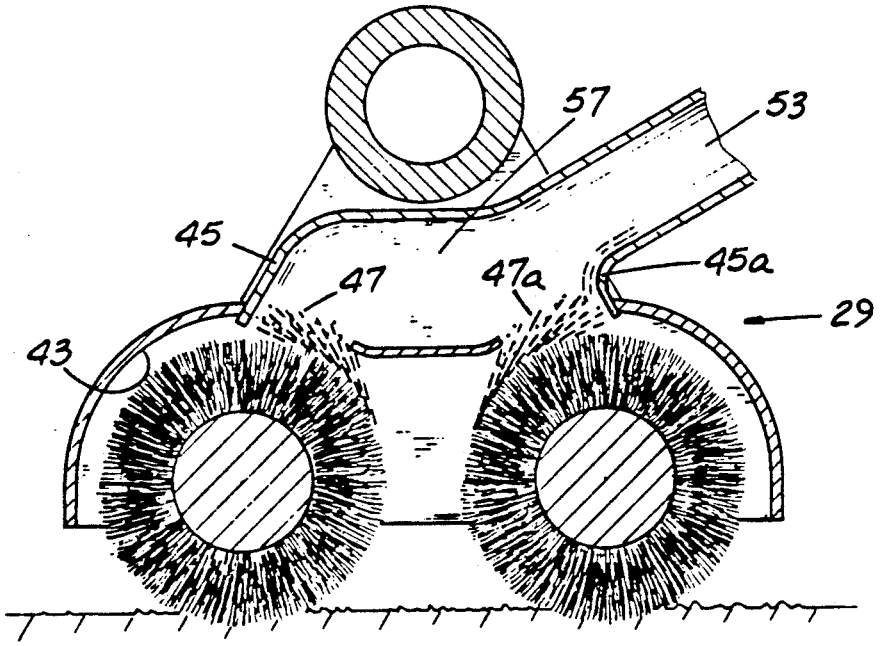
FIG. 4B is a cross-sectional side elevation view similar to FIG. 4A and showing the vacuum nozzles of the second embodiment.

Referring next to FIGS. 4A and 4B, a second embodiment of the machine 10 is arranged in recognition of a throw pattern 41 having two areas 41*a*, one each on the front portion 31 and the rear portion 33 and positioned immediately adjacent the platform 35. The first vacuum nozzle 45 and the second vacuum nozzle 45*a* each have an inlet, 47 and 47*a*, respectively, for receiving granules 11 to be removed from the carpet 12. Each inlet 47, 47*a* is adjacent the bottom surface 43 of the shroud 29 with one inlet 47, 47*a* being positioned generally coincident with each of the areas 41*a* comprising the throw pattern 41.

As in the first embodiment, each area 41*a* of the throw pattern 41 has a length extending along the brushes 13 and between the sides 55 of the machine 10. The length of each nozzle 45, 45*a* is about equal to that of the area 41*a* associated with the nozzle 45, 45*a*. Each area 41*a* also has a width and the width of each nozzle 45, 45*a* is about equal to that of the area 41*a* with which it is associated.

Each nozzle 45, 45*a* is in air-flow communication with a vacuum manifold 57 and vacuum conductor 53. This conductor 53 is connected to (or connectable to) a vacuum-creating machine 59 as described below.

Figure 5:
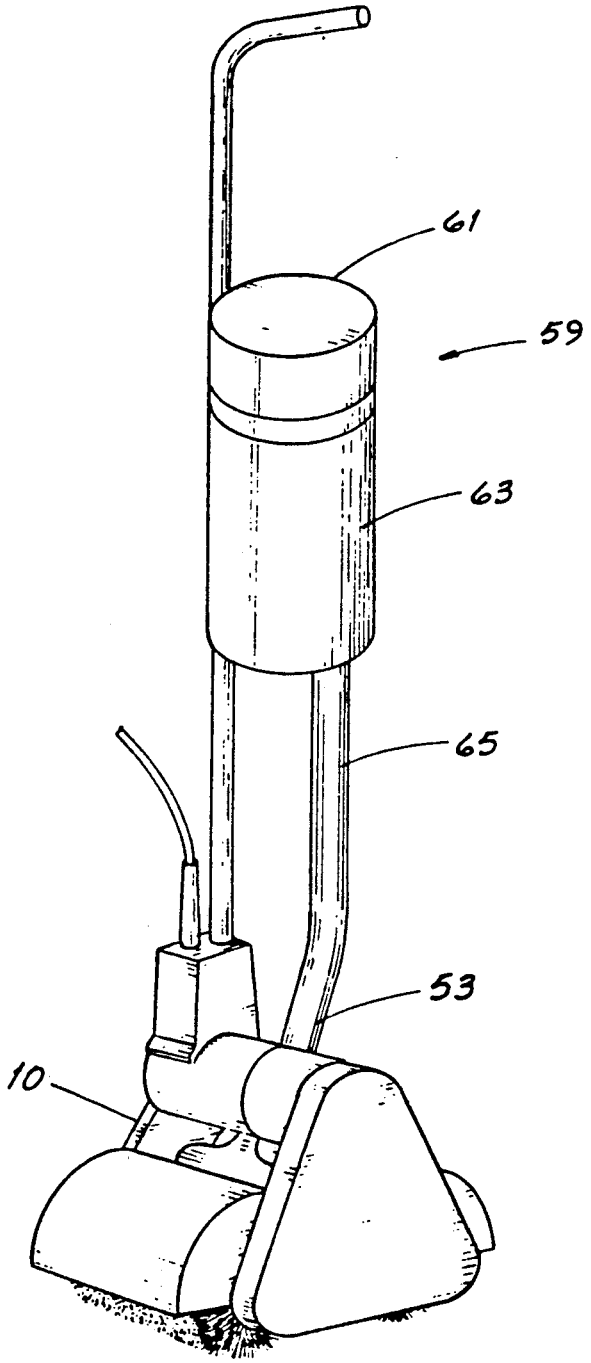
FIG. 5 is a simplified perspective view of the machine shown with a self-mounted, separately-operable vacuum unit.

Referring next to FIG. 5, the vacuum-creating machine 59 may be embodied as a separate electric motor 61 and collector housing 63 mounted on the machine 10. The motor 61 may be separately energized and the collector housing 63 is connected to the conductor 53 by a hose 65.

Figure 6:
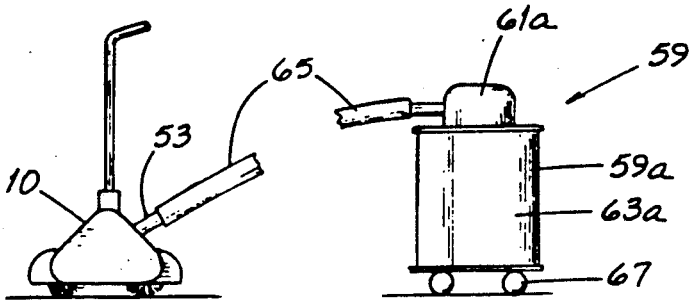
FIG. 6 is a simplified side elevation view of the machine shown in conjunction with a separate vacuum-creating machine connected thereto by flexible hose.

As shown in FIG. 6, the vacuum-creating machine 59 may be embodied as a separate, free-standing machine 59*a* connected to the conductor 53 of the machine 10 by a flexible hose 65. Such machines 59*a* are typically mounted on wheels 67 and have a separate collector tank 63*a* and a separate electric vacuum motor 61*a*. .

Figure 7:
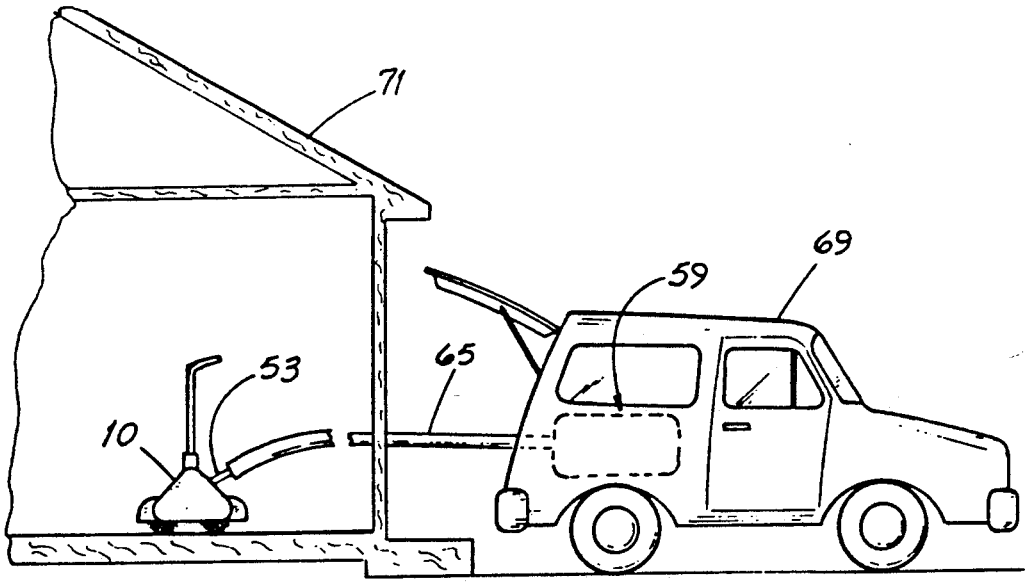
FIG. 7 is a simplified side elevation view, partly in cross section, of the machine shown in conjunction with a separate vacuum- creating machine (in dotted outline) mounted on a motor vehicle located exterior of the building in which the machine is used.

Yet another arrangement is shown in FIG. 7 wherein the vacuum-creating machine 59 is mounted on a motor vehicle 69 and is powered by its own drive motor or by the vehicle engine, neither being shown. When using the arrangement of FIG. 7, a flexible vacuum hose 65 extends from the vehicle 69 through a door or window of the building 71 in which the machine 10 used. It is to be appreciated that with any of the arrangements shown in FIGS. 5, 6 or 7, the counter-revolvingcarpet cleaning brushes 13 and the vacuum nozzle(s) 45, 45*a* are operable independently of one another. It is also to be appreciated that where a plurality of nozzles 45, 45*a* is used, such as is shown in FIG. 4B, both such nozzles 45, 45*a* operate simultaneously when the vacuum-creating machine 59 is energized.

Irrespective of the particular embodiment of the vacuum-creating machine 59, it should provide a vacuum of about 82–103 inches water at the end of the conductor 53 adjacent the machine 10 and an air flow rate of about 100 to 120 cu. ft. per minute for most effective cleaning. The foregoing assumes the machine 10 has a "footprint" of about 180 sq. in.

To use the inventive machine 10, the dry carpet cleaning granules 11, preferably those used in the HOST® system, are distributed atop the carpet 12 and thoroughly brushed into, through and across the carpet fibers 16, thereby thoroughly cleaning such fibers 16. During this cleaning operation, no vacuum is used, thereby making the entire quantity of distributed HOST® granules 11 available for carpet cleaning. After cleaning, the vacuum-creating machine 59 is energized to provide a vacuum at the inlet(s) 47, 47*a* of the nozzle(s) 45, 45*a*. With the brushes 13 operating, the machine 10 is repeatedly passed over the surface of the carpet 12 to remove the dirt-laden granules 11.

It has been found that the inventive machine 10 removes substantially all of the granules 11 from shorttufted commercial carpets 12. It has also been found that the machine 10 removes a much higher percentage of granules 11 from longer-tufted residential carpets 12 than do conventional commercial vacuum cleaners. Further, such granule removal is accomplished in about one-half the time otherwise required to remove fewer of the granules 11 using a conventional carpet vacuuming machine. Labor costs are thereby reduced.

Another advantage of the machine 10 is that the individual engaged in cleaning carpets 12, typically a professional carpet cleaner, may need only purchase, store and move a single machine 10 from job to job rather than two separate machines. Thus, the machine 10 provides significant savings in time and initial investment.

It is apparent from the foregoing that the machine 10 is highly useful in vacuuming carpets which have not been prior cleaned with granules 11. That is, such machine 10 may be used in place of a conventional vacuum cleaner.

While the principles of this invention have been described in connection with specific embodiments, it should be understood clearly that these descriptions are made only by way of example and are not intended to limit the scope of the invention.

What is claimed is:

1. An improved machine for cleaning a carpet using substantially-dry cleaning granules, the machine including:

a pair of spaced, long-bristled counter-revolving cylindrical brushes supporting the machine and stroking the granules into and across the carpet fibers;

a shroud disposed above the brushes and having a bottom surface spaced from the brushes for air flow therebetween;

a first vacuum nozzle powered by a separated vacuum motor and having an inlet adjacent to the bottom surface of the shroud receiving granules removed from the carpet;

the counter-revolving brushes simultaneously and continuously casting the granules toward the bottom surface of the shroud for vacuum collection through the inlet;

whereby the machine strokes cleaning granules into a carpet and more efficiently removes such granules therefrom.

2. The machine of claim 1 wherein the nozzle includes a pair of panels extending downwardly toward the carpet, each such panel having a lower edge positioned in closed proximity to a brush.

3. The machine of claim 2 wherein the brushes are cylindrical, the shroud has front and rear portions generally conformably shaped to the curvature of the brushes, a generally planar platform is positioned between the portions and the vacuum nozzle is mounted in the platform.

4. The machine of claim 3 wherein the vacuum nozzle is powered independently of the brushes.

5. The machine of claim 1 wherein the shroud is devoid of edges scraping the brushes and the machine further includes a second vacuum nozzle and inlet spaced from the first nozzle and inlet, such inlets vacuuming granules thrown from the brushes.

6. The machine of claim 5 wherein the brushes are cylindrical, the shroud has front and rear portions generally conformably shaped to the curvature of the brushes and a separate vacuum nozzle is mounted in each curved portion.

7. The machine of claim 6 wherein the vacuum nozzles are powered independently of the brushes.

8. An improved machine using substantially-dry cleaning granules to clean carpet and including:

a pair of spaced, long-bristled cylindrical brushes stroking cleaning granules along the carpet fibers;

a shroud having a bottom surface above and spaced from the brushes;

a nozzle having an inlet adjacent to the bottom surface of the shroud for vacuuming granules cast by the brushes;

the brushes casting dirt-laden granules against the shroud bottom surface in an area of more dense granular impact, the nozzle being positioned generally coincident with such area, whereby the machine cleans carpet and more efficiently removes dirt-laden cleaning granules therefrom.

* * * * *